US010494245B2

(12) United States Patent
Bruch et al.

(10) Patent No.: US 10,494,245 B2
(45) Date of Patent: Dec. 3, 2019

(54) CONTAINER TREATMENT MACHINE

(71) Applicant: KHS GmbH, Dortmund (DE)

(72) Inventors: Bernd Bruch, Weinsheim (DE); Ludwig Clüsserath, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 320 days.

(21) Appl. No.: 15/327,136

(22) PCT Filed: Jun. 29, 2015

(86) PCT No.: PCT/EP2015/064673
§ 371 (c)(1),
(2) Date: Jan. 18, 2017

(87) PCT Pub. No.: WO2016/008706
PCT Pub. Date: Jan. 21, 2016

(65) Prior Publication Data

US 2017/0166431 A1 Jun. 15, 2017

(30) Foreign Application Priority Data

Jul. 18, 2014 (DE) ..... 10 2014 110 107

(51) Int. Cl.

| | |
|---|---|
| ***B67C 3/26*** | (2006.01) |
| ***B08B 9/32*** | (2006.01) |
| ***B08B 9/34*** | (2006.01) |
| ***B08B 9/42*** | (2006.01) |
| ***B08B 9/44*** | (2006.01) |
| ***B67C 3/24*** | (2006.01) |

(52) U.S. Cl.
CPC ..... *B67C 3/2642* (2013.01); *B08B 9/32* (2013.01); *B08B 9/34* (2013.01); *B08B 9/423* (2013.01); *B08B 9/44* (2013.01); *B67C 3/24* (2013.01); *B08B 2209/08* (2013.01)

(58) Field of Classification Search
CPC ..... B67C 3/2642; B67C 3/24; B08B 9/28; B08B 9/30; B08B 9/32; B08B 9/34; B08B 9/423; B08B 9/44; B08B 2209/08
USPC ..... 141/144
See application file for complete search history.

(56) References Cited

U.S. PATENT DOCUMENTS 743,155 A * 11/1903 Eick ..... B08B 9/0936 134/167 R
908,446 A * 1/1909 Court ..... A47L 15/23 134/144

(Continued)

FOREIGN PATENT DOCUMENTS

DE 23 64 363 6/1975
DE 197 14 249 10/1998

(Continued)

*Primary Examiner* — Timothy L Maust
*Assistant Examiner* — James R Hakomaki
(74) *Attorney, Agent, or Firm* — Occhiuti & Rohlicek LLP

(57) ABSTRACT

A container-treatment machine includes a rotatable transport element having container holders and arranged to be pivotable by a pivoting device about a horizontal axis to pivot the container holders between feeding and treatment positions. In the feeding position, container openings of containers held by the container holders point upward. In the treatment position, they point downward. A pivot drive pivots the pivot arm, which holds the transport element so that it is rotatable by a rotary drive.

18 Claims, 7 Drawing Sheets

(56) References Cited

U.S. PATENT DOCUMENTS 993,230 A * 5/1911 Englen ..... B65B 1/22 141/78
1,958,846 A * 5/1934 Christensen ..... B08B 9/20 134/59
2,634,737 A * 4/1953 Rowe ..... B08B 9/30 134/126
2,671,457 A * 3/1954 Cozzoli ..... B08B 9/28 134/134
2,671,742 A * 3/1954 Cozzoli ..... B08B 9/28 134/22.11
2,675,011 A * 4/1954 Maddaford ..... B08B 9/32 134/134
3,270,487 A * 9/1966 Tchimenoglov ..... B67C 3/24 53/393
3,511,358 A * 5/1970 Peterson ..... A21B 3/07 198/632
4,667,690 A * 5/1987 Hartnig ..... B08B 9/30 134/129
5,409,545 A * 4/1995 Levey ..... B08B 9/205 134/129
5,582,285 A * 12/1996 Kronseder ..... B65G 29/00 198/473.1
5,909,796 A * 6/1999 Soldavini ..... B65G 47/647 198/369.2
6,009,889 A * 1/2000 Brenkus ..... B08B 9/30 134/22.12
6,409,011 B1 * 6/2002 Ferguson ..... B65G 15/00 186/68
7,770,720 B2 * 8/2010 Freudelsperger ..... B65G 21/00 198/583
8,356,461 B2 * 1/2013 Cedrone ..... B67C 7/0033 53/284.5
2008/0317624 A1 * 12/2008 Gueguen ..... A61L 2/07 422/26
2009/0205746 A1 * 8/2009 Yousefpour ..... B08B 3/02 141/92

FOREIGN PATENT DOCUMENTS

| | | |
|---|---|---|
| DE | 691 04 582 | 6/2000 |
| DE | 10 2006 028266 | 12/2007 |
| EP | 0 345 470 | 12/1989 |
| EP | 2 532 447 | 12/2012 |

* cited by examiner 100
106
112
114
111
104
20
36
40
34
108
101
102
20,112
34, 40
110
50
36
28

CONTAINER TREATMENT MACHINE

RELATED APPLICATIONS

This application is the national stage under 35 USC 371 of international application PCT/EP2015/064673, filed Jun. 29, 2015, which claims the benefit of the Jul. 18, 2014 priority date of German application DE 102014110107.3, the contents of which are herein incorporated by reference.

FIELD OF INVENTION

The present invention relates to a container treatment machine for treating containers.

BACKGROUND

Container treatment machines for treating containers typically have a rotor that that conveys the containers to various treatment devices, such as sprayers and blowers. These containers must be held. A typical holding device includes tongs that project radially outward from a conveyor wheel and arranged on a carrier. The carriers then rotate by way of shafts on the conveyor wheel so that the containers, which are fed upright, can be turned about a horizontal axis so that they may be sprayed out and blown out. The carriers can also be displaced radially on the conveyor wheel so as to be able to keep the containers as closely and evenly spaced apart as possible and to avoid collisions when turning.

SUMMARY

In one embodiment, the invention features at least one transport element that has container holders and that can be driven to rotate about an axis of rotation and with which the containers to be treated, which are fed through a container inlet, can be conveyed to treatment stations and, after treatment there, to a container outlet.

An object of the invention is to further develop a generic container treatment machine so that the containers can be treated while they are upside-down, for example, for rinsing, for chemical or physical treatment (UV light, radioactive irradiation, electrostatic discharge etc.) or for gauging the container's interior.

According to the invention, the transport element together with the container holders is arranged to be able to pivot about a horizontal axis by way of a pivoting device. As the transport element is pivoted, its container holders are pivoted between feeding positions in which the containers are oriented with their container openings upward and a treatment position in which they are oriented with their container openings downward. The advantage of the inventive device lies in the fact that the transport element facilitates the feeding of the machine with containers and a simultaneous pivoting of a plurality of containers into an upside-down position with technically simple means.

In this way the transport element of the container treatment machine, also referred to hereinafter as "machine" for short, can be configured in an embodiment as an arc ring, i.e. preferably as an arc ring of no more than 180°. The angle covered by the arc ring may also be greater than this however.

On its outer periphery this arc ring has container holders that are filled with containers in a feeding position at the container inlet. After each filling with a container, the transport element rotates on by one pitch, corresponding to the index distance between the container holders, until all container holders of the transport element have been fed. The entire transport element is then pivoted about a horizontal axis by a pivoting device and preferably through an angle of 180° so that, as the transport element is pivoted, the containers fed in the feeding position with the container opening pointing up are rotated into a treatment position in which the container opening is essentially pointing down. The pivoting device can, however, be configured to rotate the transport element through a full circle of 360 degrees.

In some embodiments, the transport element is held on a carrier, so that it can be rotated by a rotary drive, and the pivoting device incorporates a pivot drive, for pivoting the carrier. This embodiment is very easy to realize as it makes use of a conventional design of a transport element that is mounted so that it can only pivot by way of the pivoting device. Existing container treatment machines can also be upgraded with the pivot function in this way.

It is usual for the transport element to be configured as a transport star that comprises the container holders around its outer periphery. Recesses that match the geometry of the containers are usually configured in the container holders on the outer periphery of the transport element. However they can also be attached to the transport element as discrete elements taking the form of clamps or grippers that act on the container circumference or on the container mouth.

It is preferable for the container treatment machine to comprise at least one guide element, such as a guide plate, that ensures that the containers stay in the container holders while the transport element is pivoted.

The treatment position is preferably provided with spray jets that are arranged beneath the container mouth or that can also project into the containers when they are pivoted into the treatment position by way of the transport element and the pivoting device. The containers can then be easily rinsed in this way. To make the introduction of the spray jets into the containers, e.g. bottles or kegs, easier, the spray jets can also be vertically movable so that the spray jets can be introduced vertically upward into the containers once the latter have reached their treatment position.

The pivot angle of the pivoting device is preferably 180°, with which the containers are tipped from a position in which the container opening is vertically upwards to a position in which the container opening is vertically downwards. This is a position that is very well suited for treatment. In this position the containers can, for example, be cleaned by a spray jet, by an electrostatic discharged formed through a conducting pathway of ionized air, or gauged by means of an internal measuring probe.

It is of course not necessary for the transport element to comprise the container holders over part of a circle only, or for the transport element itself to be configured over part of a circle only. It is also possible for the transport element to be configured over a full circle and to comprise container holders at equal angular distances, also referred to as the "pitch," over its entire outer periphery. In this case all container holders can be pivoted over the full circle, in which case the container treatment machine should preferably be configured so that the pivoting of the transport element is accompanied by a translation. This permits the treatment position of each container to be spaced apart from the feeding positions. This can be easily realized, for example, if the transport element is held on a carrier, e.g. a pivot arm, which pivots the transport element not only through 180° but also sideways out of the region of the feeding positions altogether. The carrier or pivot arm is preferably oriented at right angles to the axis of rotation of the pivoting device.

In the treatment position for each container, the container treatment machine preferably contains at least one upward-facing spray jet that projects into the container when the latter is upside-down in the treatment position. In this way the container treatment machine can easily be realized as a rinsing machine for containers.

In this case the spray jets are preferably arranged so as to be vertically movable so they can be introduced over some distance into the container interior to ensure thorough cleaning of all regions of the container interior.

In a readily realizable embodiment of the invention, the spray jets of the treatment positions are arranged at a vertically movable distributor, in which case the spray jets are moved not individually but together by way of the distributor. This arrangement is technically simple to realize.

The distributor preferably contains a horizontally extending distributor pipe curved in the manner of an arc of a circle such that it extends at least under part of all treatment positions of the machine and preferably under all treatment positions. In a simple embodiment, the distributor function is combined with the structural support function of the distributor for the spray jets. A plurality of contiguously arrayed distributor pipes having different spray media can also be provided.

A plurality of jet strings having different spray media can also be arranged, in which case the containers can be moved from spray station to spray station by a pivoting and/or rotary motion.

Preferably the transport element is a transport or transfer star comprising, on its periphery, a plurality of pocket-like container holders that are open on the periphery side and that are provided at equal angular distances from one another relative to the axis of rotation. The machine can be easily index-operated in this way. The control of such a machine is simple to realize because the index increments are identical. The transfer stars can, however, also be equipped with grips or clamps to hold the containers so that pocket-like container holders can be dispensed with.

In this case the transport or transfer star need not cover a full circle of 360° but can also encompass an arc of more or less than 180°, e.g. in an embodiment as an arc ring. This simplifies realization of the pivot movement.

The container treatment machine preferably contains at least one conveyor device for feeding and removing the containers, with at least part of the conveyor device located beneath the transport element being pivotably arranged. On the one hand, this allows the conveyor device to be pivoted out of the way during the pivoting of the transport element so that they do not impede one another's movement. Because of this it is then also possible to position two or more transport elements, which can be rotated or pivoted independently of one another, on one pivot axis, which requires a pivoting range of 360°. On the other hand, easy access to the container treatment machine from below is possible in this way. In this case the pivotable part of the conveyor device is preferably configured so that it can be pivoted downward. This creates a space beneath the transport element without needing additional space at the sides.

If a part of the conveyor device is pivotable, then the pivoting of that part of the conveyor device can be synchronized with the pivoting of the transport element by way of the pivoting device. This can be accomplished with a controller of the container treatment machine and/or a controller of the filling plant.

The invention also relates to a filling plant that has a container treatment machine according to any one of the previous embodiments. In addition to the container treatment machine, the filling plant also contains at least one conveyor device and a filling device for the containers.

The containers can be bottles, PET bottles, or glass bottles, cans, kegs or party cans, to name but some.

The containers need not necessarily be pivoted through 180° although this represents the preferred embodiment. The containers can also be rinsed when in a position in which they are not exactly aligned vertically downward.

BRIEF DESCRIPTION OF THE DRAWINGS

The invention is described below by way of example by reference to the schematic drawing in which.

DETAILED DESCRIPTION

Figure 1:
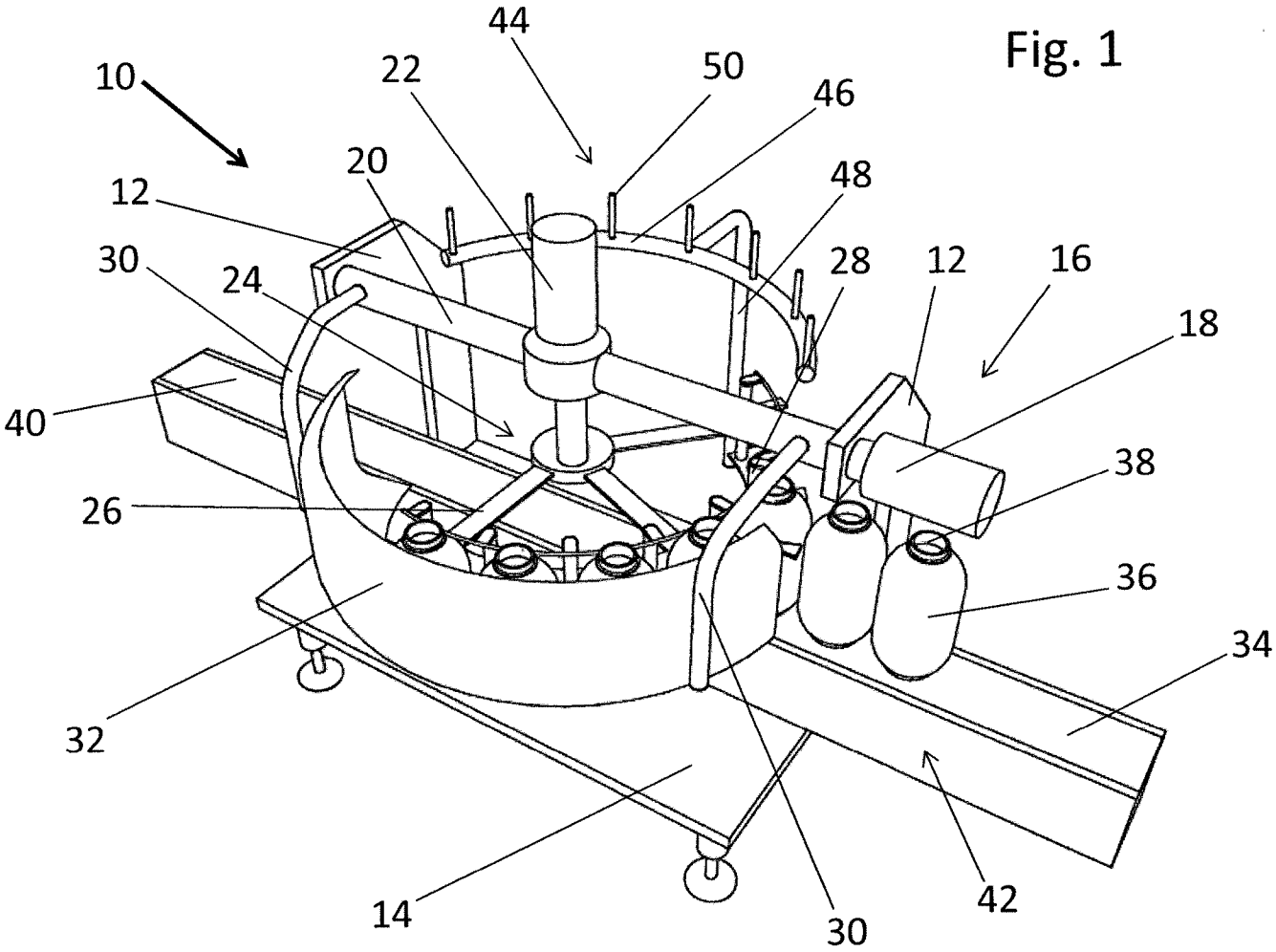
FIG. 1 shows a perspective view of a container treatment machine with containers partly in the feeding position.

FIG. 1 shows a perspective view of a container treatment machine 10, having a frame 12 that has a pedestal 14. A pivoting device 16 on an upper end of the frame has a pivot drive 18 that rotates a pivot shaft 20. A rotary drive 22, which drives a transport star 24, is arranged in the center of pivot shaft 20.

Figure 2:
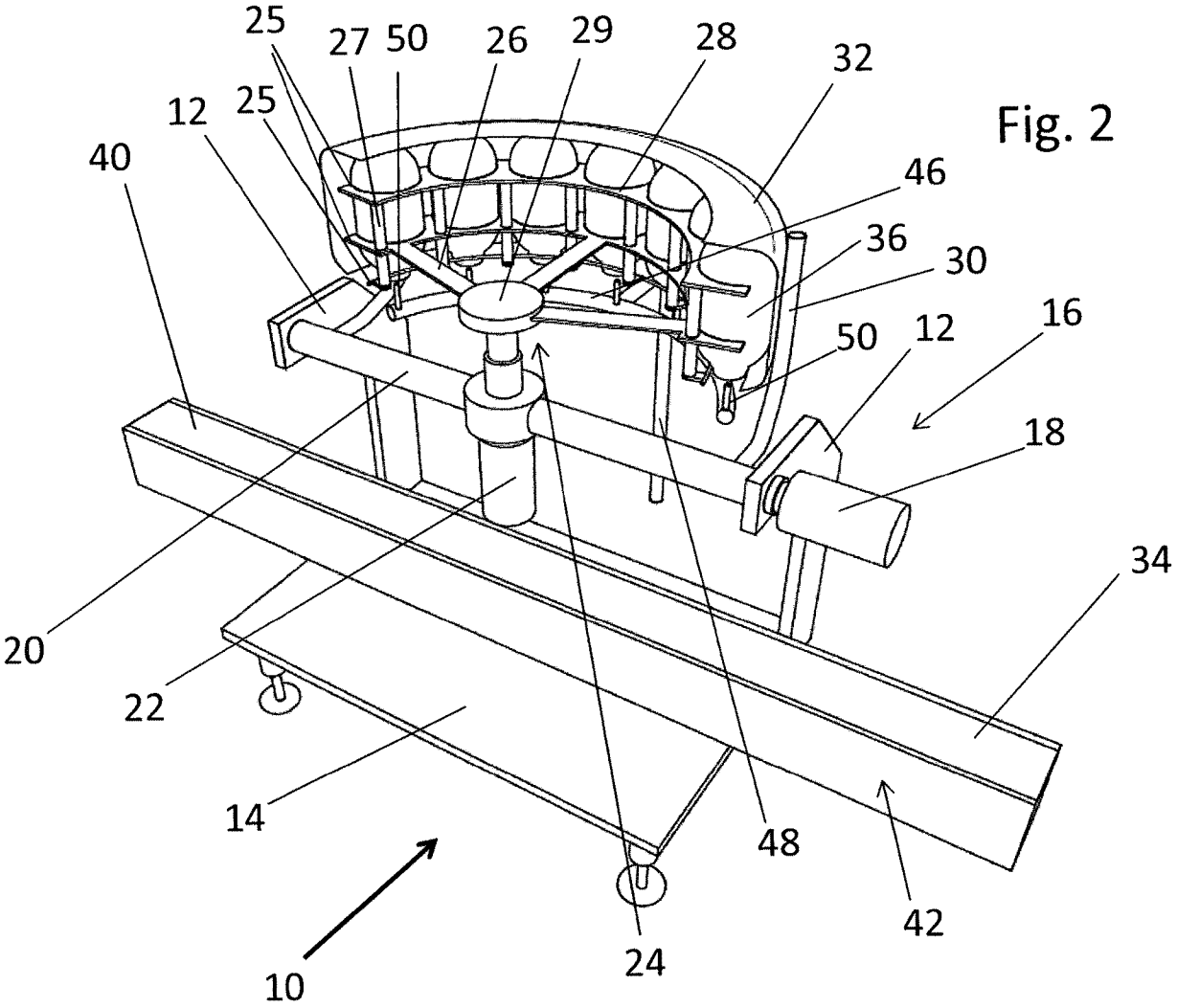
FIG. 2 shows a perspective view of the container treatment machine of FIG. 1 with the containers in the treatment position.

In FIG. 2, it is possible to see that the transport star 24 has arc rings 25 that are interconnected by vertical studs 27. The arc rings 25 have container holders 28 on their outer periphery. Radial spokes 26 connect the arc rings 25 to a hub 29 that is driven by the rotary drive 22. The pivot shaft 20 also connects to holding arms 30 that comprise a guide plate 32 that holds the containers 36.

The containers 36 enter through a container inlet 34 in feeding positions in which, after the complete feeding of the transport star 24, the containers 36 are arranged in the container holders 28 so that they are aligned with their container openings 38 pointing upwards.

The container treatment machine 10 also comprises a container outlet 40 onto which the containers 36 are transferred following their treatment in the treatment machine. A conveyor device 42 forms both the container inlet 34 and the container outlet 40.

The transport star 24 covers a little less than 180° of an arc of a circle. When fully fed, it has seven feeding positions. As a result, it can hold seven containers for simultaneous treatment.

Upon actuation of the pivoting device 16, the rotary drive 22 pivots. As it pivots, so does the transport star 24, via the hub 29. The transport star 24 thus pivots from the feeding position, shown in FIG. 1, to the treatment position, shown in FIG. 2. In the process, the containers 38, which are present in the treatment positions, also pivot. Upon pivoting, the containers 38 are over a distributor 44 that is formed by a horizontally extending arcuate distributor pipe 46 that is held on a supply pipe 48. The supply pipe 48 holds the distributor pipe 46, thus rendering it optionally vertically movable.

The distributor pipe 46 contains, for example, seven spray jets 50 directed vertically upward. These correspond to the seven treatment positions of the fully fed container-treatment machine 10, as depicted in FIG. 2.

The mode of operation of the container-treatment machine 10 in FIGS. 1 and 2 is explained as follows.

The containers 36 are fed to the container holders 28 of the transport star 24 via the container inlet 34. The transport star 24 is configured over an arc of a circle. The extent of the arc is slightly less than 180°. The transport star 24 has, on its outer periphery, the seven container holders 28. When the transport star 24 is fully fed, these correspond to the seven feeding positions.

The containers 36 are fed to these container holders 28 by the feeding operation shown in FIG. 1. As they are being fed, the containers are held in their feeding position between the container holders 28 of the transport star 24 and an external guide plate 32. As a result, when actuation of the pivoting device 16 triggers the pivoting maneuver, the containers 36 do not fall out of their container holders 28.

When the pivoting device 16 is actuated, the pivot shaft 20 rotates. As a result, the entire transport star 24, together with the container holders 28 and the guide plate 32, rotates. This turns the containers upside-down beside the conveyor device 42. In the process, the container openings 38 of the containers 36 end up lying above the spray jets 50 of the distributor pipe 46.

The treatment position shown in FIG. 2 can be configured in such a way that the container opening 38 projects over the spray jets 50. The spray jets thus project into the container interior. Alternatively, the distributor pipe 46 can be moved vertically upward by way of the supply pipe 48. This moves the spray jets 50 vertically so that they project into the container's interior.

In the treatment position shown in FIG. 2, the containers 36 can be cleaned and/or gauged or otherwise prepared for a subsequent filling. For example, the containers 36 can be provided with a disinfectant, a fungicide, or another chemical substance.

The treatment machine shown in FIGS. 1 and 2 therefore facilitates a simultaneous upside-down treatment of the seven containers in a configuration that is technically simple to build.

Figure 3:
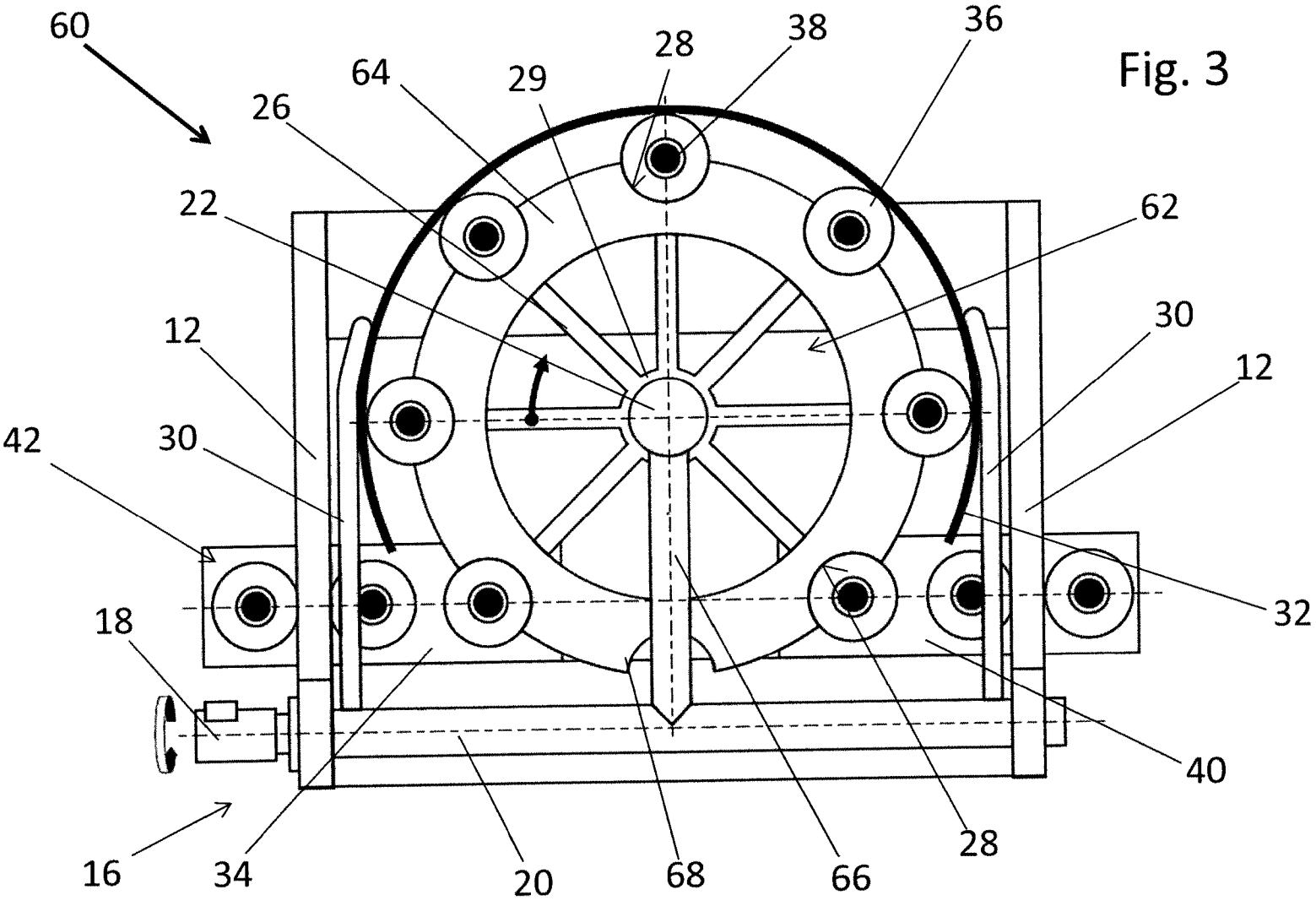
FIG. 3 shows a top view of a second embodiment of a treatment machine in which the transport element is configured over a full circle.
Figure 4:
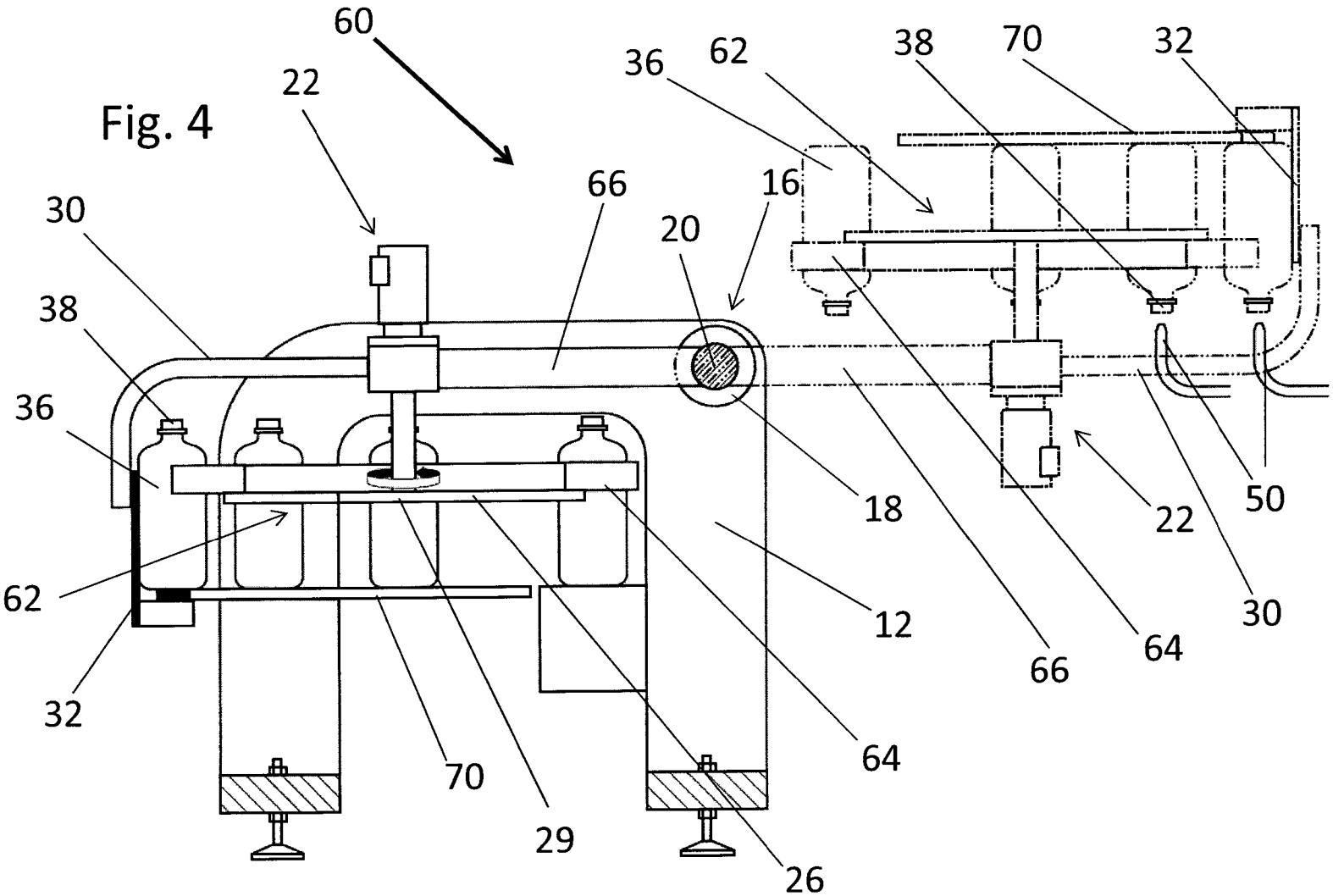
FIG. 4 shows a side view of the treatment machine of FIG. 3, FIGS. 5*a* and 5*b* show a further embodiment of the invention, in which a partially folding conveyor device is provided.

FIGS. 3 and 4 show a further embodiment of container-treatment machine 60. The same reference numbers identify those elements that are identical to or have the same function as corresponding elements in FIGS. 1 and 2.

The treatment machine 60 as shown in FIGS. 3 and 4 differs from the container-treatment machine 10 in FIGS. 1 and 2 by having a transport star 62 that is configured as a full circle. The transport star 62 thus consists of a carrier ring 64 on whose outer periphery container holders 28 are provided at equal angular distances. The carrier ring 64 has eight container holders 28 that are preferably configured as circular recesses to match the outer contour of the containers 36. As was the case in connection with FIGS. 1 and 2, the containers 36 are held by a guide plate 32 that is held with supporting arms 30 on the pivot shaft 20 so that the containers cannot slip out of the container holders 28 during the pivoting maneuver. The supporting arms 30 can also be operable by a separate second pivoting device. Once all of the container holders 28 have been charged, a guide plate 32 configured as a full circle can be put over the transport star 62. In this case, the supporting arms 30 for the guide plate 32 are preferably arranged at right angles to the pivot shaft 20 of the pivoting device 16.

Because a full-circle transport star 62 has to be pivoted in the embodiment shown in FIGS. 3 and 4, the rotary drive 22 for the transport star 62 is arranged on a carrier in the form of a pivot arm 66 that is preferably oriented at right angles to the pivot shaft 20 and connected to the latter. In this way, as the pivot arm 66 is pivoted, the container 36, which is in feeding position 68 that is nearest to the pivot shaft 20, is transferred by the pivoting device 16 to the treatment positions that are at a clear distance away from the feeding positions and in which the containers are positioned above the spray jets 50.

In the embodiment of FIGS. 3 and 4, the guide plate 32 is also connected to a base element 70 that ensures that, during the feeding of the transport star 62, the containers 36 can slide across with their container bases from one position to the next and that also securely holds the containers 36 during the pivoting maneuver from the feeding positions shown in FIG. 3 to the treatment positions shown in FIG. 4.

Figure 5B:
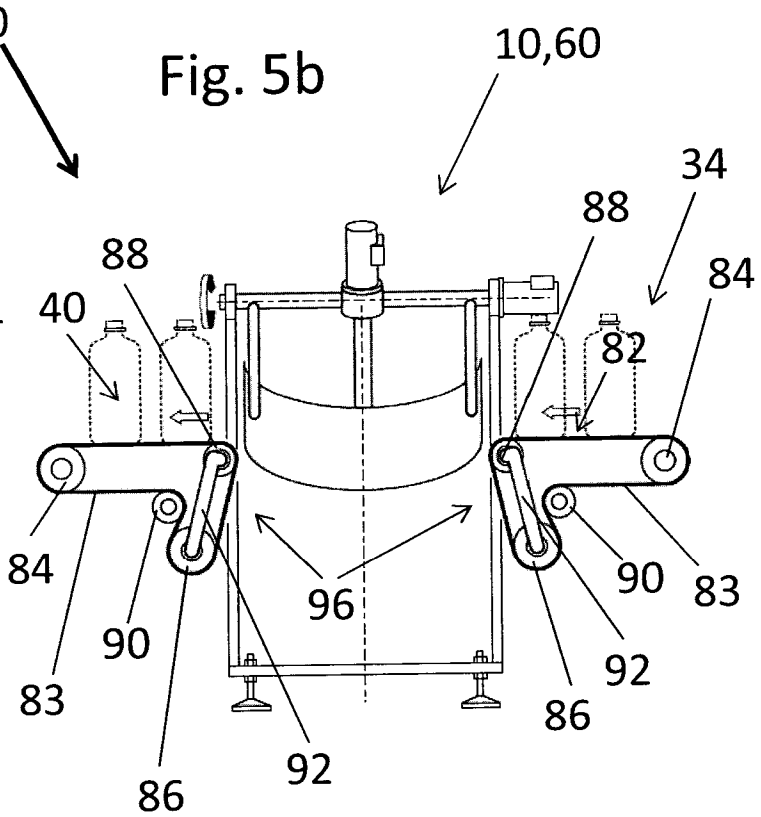
Figure 5A:
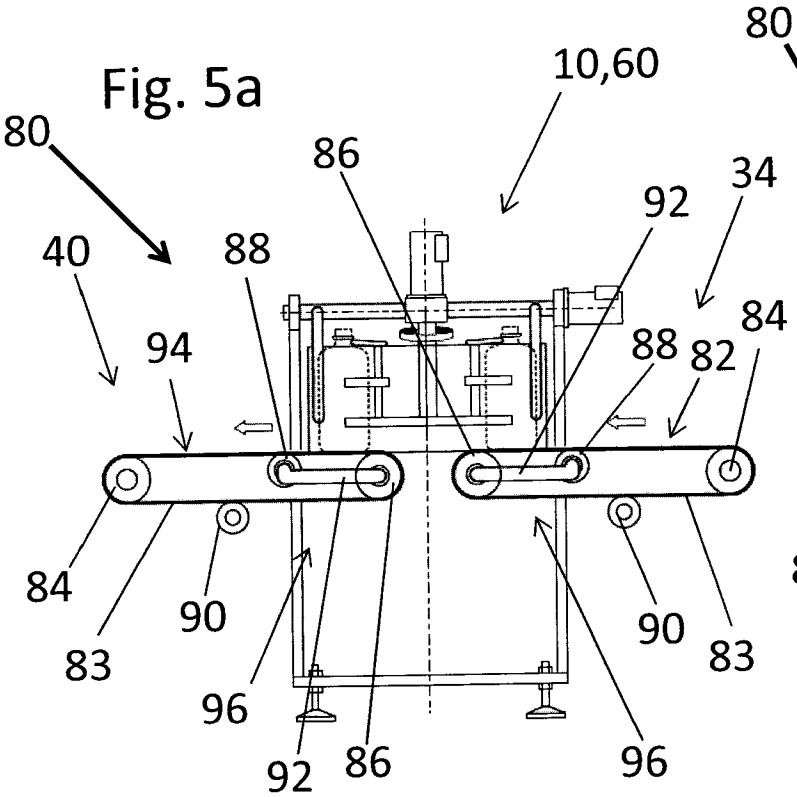

FIGS. 5*a* and 5*b* show a side view of part of a filling plant 80 for filling containers with liquid product. The filling plant 80 contains a container treatment machine 10, 60 similar to that discussed in connection with FIGS. 1 to 4 with the difference that now, two separate conveyor devices are provided instead of one conveyor device 42. In the embodiment shown in FIGS. 5*a* and *b*, the container inlet 34 is realized by a first conveyor device 82 that comprises a conveyor belt 83 that is guided between first and second end rollers 84, 86, with at least one of the first and second end rollers 84, 86 being driven. In addition to the first and second end rollers 84, 86, the first conveyor device 82 comprises a guide roller 88 and a back roller 90, with the pivot axis of the pivot lever 92 being coaxial with the guide roller 88 and the second end roller 86 mounted so that it can pivot relative to the guide roller 88. In a manner identical to the container inlet 34, the container outlet 40 is formed by a second conveyor device 94 that comprises two end rollers 84, 86, a pivot lever 92 mounted on guide roller 88, and a back roller 90. FIG. 5*a* shows the position of the first and second conveyor device 82, 94 during the feeding of the container treatment machine 10, 60. As soon as the container treatment machine 10, 60 is fed, a part 96 of the first and second conveyor devices 82, 94 that is located beneath the container treatment machine 10, 60 is folded down, as can be seen in FIG. 5*b*. In the process, pivot levers 92 are pivoted downwardly by way of a second pivoting device (which is not described further), as a result of which the conveyor belts 83 are folded away downwardly over the guide roller 88 and the back roller 90. In this way, the pivoting maneuver of the pivoting device of the treatment machine can be effected in such a way that it projects into the conveying level of the two conveyor devices 82, 94. This embodiment facilitates a pivoting maneuver of the pivoting device 16 of 360° and better access to the container treatment machine 10, 60 from below.

FIG. 6 shows a container treatment machine 100 that comprises a rotary drive 102 that is mounted on a column 101 and on which is held a transport star 104 in the form of an arc of a circle having four container holders 28. The pivoting device 106 is arranged on a head mounting 110 at an upper end of the rotary/lift rod 108, which is driven to rotate by the rotary drive 102. The pivoting device 106 incorporates a pivot drive 111, e.g. a servomotor. The pivot drive 111 rotates a pivot shaft 112. The pivot shaft 112 is connected to the transport star 104 by way of the carrier 114 that is configured as a pivot arm. This permits the pivoting device 106 to pivot the transport star 104 through 180 degrees.

Figures 6A, 6B, 6C:
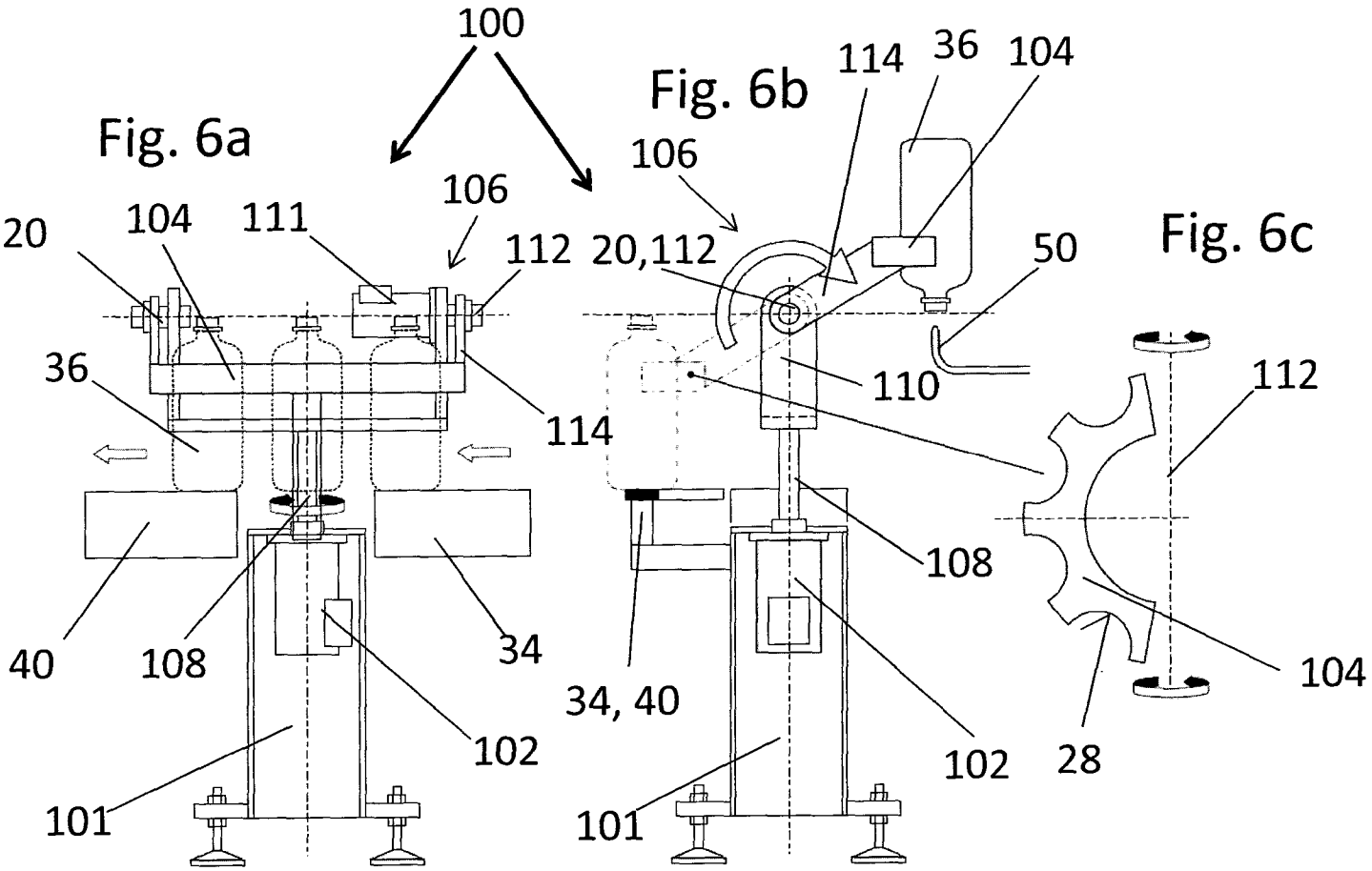
FIGS. 6*a*, 6*b*, and 6*c* show a further embodiment of the invention in a side view, with FIG. 6*a* showing a side view square to the conveyor device of the containers, FIG. 6*b* a side view in the conveying direction, and FIG. 6*c* a detail of the container holders.

The container treatment machine 100 also comprises a container inlet 34 and a container outlet 40. FIG. 6*b* shows the pivoting of the transport star 104 by way of the pivoting device 106 between the feeding position of the containers 36 (the broken line) and the treatment position (the unbroken line). FIG. 6*c* shows the arc-like configuration of the transport element 104 and its direction of pivoting about the pivot shaft 112, as can particularly be seen in FIG. 6*b*.

In this embodiment, additional guides (not shown) can be provided to hold the containers in the container holders 28 during the pivoting maneuver. If the containers 36 are made of ferrous metal, they can also be held in the transport element 104 by magnetic holders, in which case no additional guides are necessary. When, in the treatment position shown in FIG. 6*b*, the container 36 is arranged with its container opening 38 facing vertically downward over corresponding spray jets 50, which can also be optionally raised vertically up into the container 36.

Figure 7:
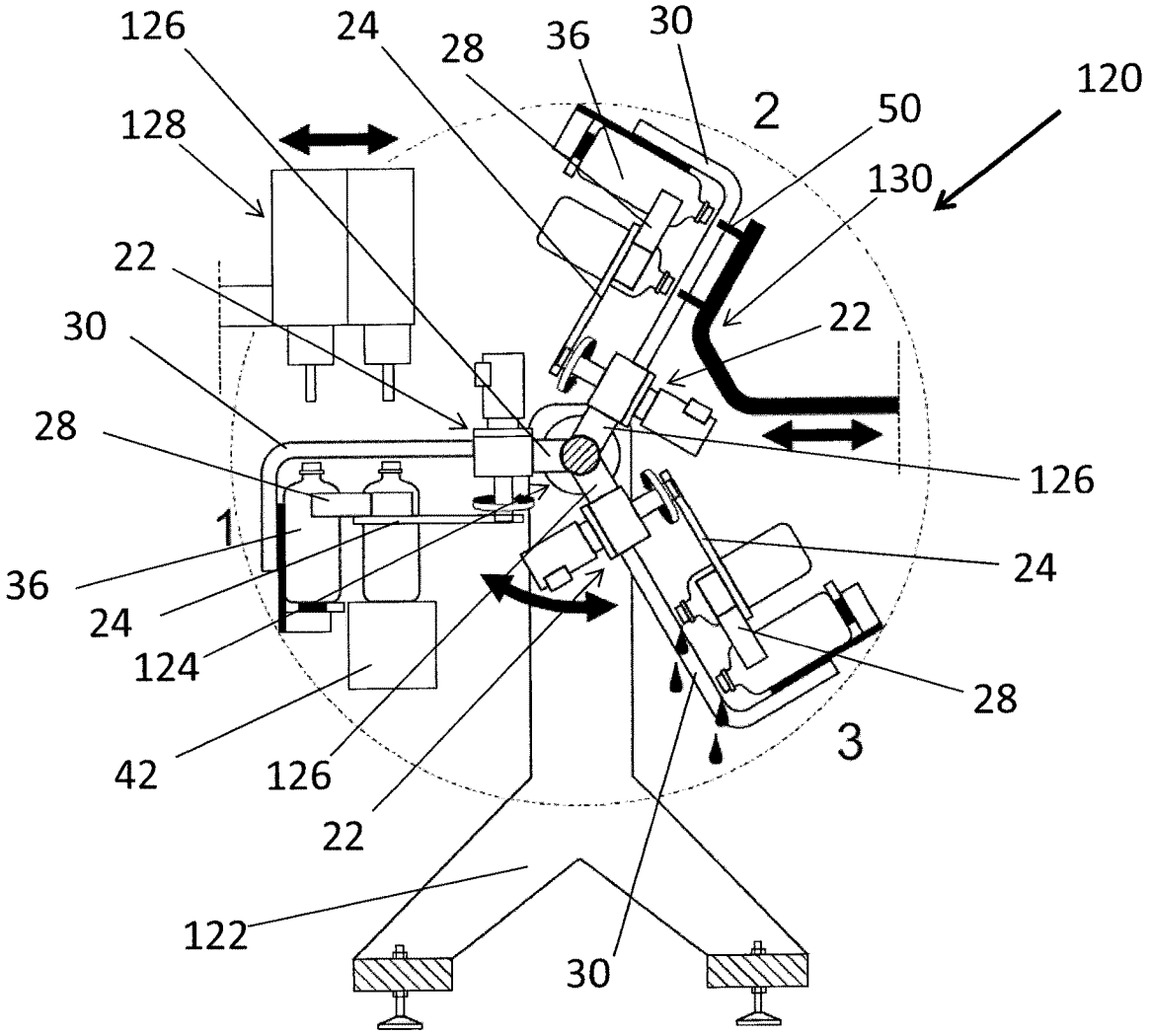
FIG. 7 shows a further embodiment of the invention which has a pivoting device comprising a plurality of transport stars.

Finally, FIG. 7 shows a container treatment machine 120 that, on a carrier frame 122, comprises a pivoting device 124 having three, preferably identical, pivot arms 126 at 120° intervals. The pivoting device 124 can rotate the three pivot arms 126 through a full circle of 360 degrees. Each pivot arm 126 has a rotary drive 22 that carries a transport star 24 configured as an arc of a circle. Each pivot arm 126 also has a supporting arm 30 that holds received containers 36 in the container holders 28 of the transport stars 24 during their transfer to or treatment in the treatment positions.

The treatment machine 120 comprises first, second, and third positions 1, 2, 3. Above the first horizontal treatment position 1, which is configured as a filling position, a filling device 128 is arranged so that, in the plane of projection, it can be moved according to the double arrow as well as up and down. As a result, its filling jets can be arranged above or inside the container openings. The containers 36 are fed to the first treatment position 1 of the container treatment machine 120 by a conveyor device 42 and are transferred to the container holders 28 as the transport star 24 rotates. Then, the pivot arms 126 are turned by way of the pivoting device 124 from the first treatment position 1 to the second treatment position 2.

The second treatment position 2 is turned on a horizontal axis of rotation, square to the plane of projection, by 120 degrees relative to the horizontal first treatment position 1 such that the containers 36 are in an approximately upside-down position. In this position, there is arranged a spray device 130 with spray jets 50 that can be moved relative to the containers 36 located in the second treatment position 2 in such a way that the spray jets 50 are directed into the container interior. In this position, the containers are treated with a treatment medium such as a disinfectant or a fungicide.

The entire path from the second treatment position 2 to the third treatment position 3 is intended as a drip section to remove as much of the treatment medium sprayed into the containers 36 by the spray device 130 from the containers as possible. An optional gas blow-in device can be arranged in the treatment position 3 to remove remaining traces of the spray medium.

Finally, the pivot arm 126 of the pivoting device 124 rotates onward so that it re-enters the treatment position 1 where the containers 36 that have been pre-treated in the second and third treatment positions 2 and 3 can now be filled by the filling device 128. The advantage of this embodiment is that the cycle time for the treatment in the first, second, and third treatment positions 1, 2, 3 can be significantly reduced by there being three pivot arms 126. A continuous full-circle rotation of the pivoting device 124 with brief stops at the treatment positions also produces a more fluid overall motion than a pivoting device in which the containers are pivoted back and forth through degrees, for example.

It was assumed above that the pivoting motion of the pivoting device 16, 106 takes place in alternate pivoting directions so that the pivot angle of the pivoting device 16, 106 does not exceed 360°, thereby simplifying the transmission of media, control signals and operating energy since with this modus operandi, the rotary transmitters or rotary bushings can be dispensed with. Alternatively, provision is made for the pivoting device to also execute pivot angles that exceed 360°. The advantage of this option is that the time required for the pivoting movements can be reduced in certain applications.

Only one treatment medium has so far been assumed for the sake of simplicity. However, nothing prevents the apparatus as described herein from using a plurality of, and also different, treatment media.

It has so far been assumed, for the sake of simplicity, that the spray jets 50 can only move vertically. According to the invention, the spray jets 50 can also be configured to move horizontally instead of vertically, or to move horizontally in addition to vertically. The same also applies to the distributor 44.

It has also been assumed so far that the jets for the treatment medium are only arranged positioned at the treatment stations provided. However, it is also possible for jets for the treatment medium/media to be arranged between two treatment stations. This configuration also allows a container to be treated, for example with a spray or cleaning medium, en route from one treatment station to the next. The spray jets may also be disposed around the periphery of the transport star 24 so that the exterior of the containers can be treated.

For the sake of simplicity, it has always been assumed so far that the container holders are pockets that open towards the periphery. But this is not essential. In some embodiments, the container holders are configured as holding, gripping, or clamping systems that hold the containers by any one or more of the container's base, its body, its mouth, and a region under its mouth.

The features of the embodiments described above can be combined with one another in any desired way so far as is technically feasible. It is pointed out that individual technical components of the inventive container treatment machine can be configured singly or in multiples. Functional elements can also be subdivided over multiple components as complete functional elements or as part-elements. This applies in particular to the controller of the container treatment machine, which can be incorporated in the control system for an entire filling plant. The invention can be varied within the extent of protection conferred by the following claims.

The invention claimed is:

1. An apparatus comprising a container-treatment machine for treating containers, said container-treatment machine comprising a transport element, container holders, a container inlet, a container outlet, a pivoting device, a pivot drive, a pivot arm, and a rotary drive, wherein said transport element comprises said container holders, wherein said transport element is configured to be driven to rotate about an axis of rotation, wherein said container inlet receives containers to be treated, wherein said transport element conveys said containers to treatment stations for treatment, wherein said container outlet receives and then discharges containers that have been treated at said treatment stations, wherein said transport element, together with said container holders, is arranged so as to be pivotable by said pivoting device about a horizontal axis, wherein said container holders are pivotable between a feeding position and a treatment position, wherein, in said feeding position, container openings of containers held by said container holders point upward, wherein, in said treatment position, container openings of containers held by said container holders point downward, wherein said pivot drive pivots said pivot arm, wherein said pivot arm holds said transport element so that said transport element is rotatable by said rotary drive, and wherein said container holders are distributed along said transport element around a pitch arc that defines a portion of a circle.

2. The apparatus of claim 1, wherein said pivoting device pivots around a pivot angle that extends between 60° and 360 degrees.

3. The apparatus of claim 1, wherein said container holders are distributed along said transport element across a pitch arc that extends between 120 degrees and 360 degrees.

4. The apparatus of claim 1, wherein said container holders are distributed along said transport element around a pitch circle.

5. The apparatus of claim 1, wherein said pivoting device pivots around a pivot angle that extends more than 360 degrees.

6. The apparatus of claim 1, further comprising an upward-facing spray jet, wherein, when said container holders are in said treatment position, said spray jet is directed into a container.

7. The apparatus of claim 1, further comprising a vertically-movable spray jet oriented to direct spray upward and into a container when said container holders are in said treatment position.

8. The apparatus of claim 1, further comprising a spray jet oriented to direct spray upward to spray into a container when said container holders are in said treatment position, said spray jet being movable in a horizontal direction.

9. The apparatus of claim 1, further comprising upwardly-facing spray jets and a vertically-movable distributor on which said spray jets are arranged, and wherein, when said container holders are in said treatment position, said spray jets are directed into corresponding containers.

10. The apparatus of claim 1, further comprising upwardly-facing spray jets and a distributor, wherein said spray jets are arranged on said distributor, wherein said distributor is horizontally-movable, and wherein, when said container holders are in said treatment position, said spray jets are directed into corresponding containers.

11. The apparatus of claim 1, further comprising upwardly-facing spray jets and a movable distributor that comprises a distributor pipe, wherein said spray jets are arranged on said distributor, wherein said distributor pipe extends horizontally along a curve that follows an arc of a circle, and wherein said distributor pipe extends under said container holders when said container holders are in said treatment position.

12. The apparatus of claim 1, wherein said transport element comprises a transfer star having a periphery on which are disposed container pockets that have openings facing a peripheral direction, said pockets being disposed at equal angular distances from each other.

13. The apparatus of claim 1, further comprising a conveyor device for feeding and removing said containers, wherein at least a part of said-conveyor device that is located under the transport element is able to pivot.

14. The apparatus of claim 1, further comprising a conveyor device having a downwardly-pivotable part located under said transport element, said conveyor device being configured for feeding and removing said containers.

15. The apparatus of claim 1, further comprising a conveyor device for feeding and removing said containers, wherein a synchronously-pivoting part of said conveyor device is located under said transport element, said part being configured to pivot in a manner synchronized with pivoting of said transport element by said pivoting device.

16. The apparatus of claim 1, further comprising a guide element, said guide element being configured to keep containers in corresponding container holders during pivoting by said pivoting device.

17. The apparatus of claim 1, further comprising a container filling device for filling said containers with liquid filling material, said filling device and said container-treatment machine being constituents of a filling plant.

18. The apparatus of claim 1, further comprising a guide element, wherein containers are held between said guide element and corresponding container holders so as to keep containers in said corresponding container holders during pivoting by said pivoting device.

* * * * *